US006121587A

United States Patent [19]

Leiprecht et al.

[11] Patent Number: 6,121,587

[45] Date of Patent: Sep. 19, 2000

[54] RADIANT HEATING ELEMENT FOR A COOKING AREA

[75] Inventors: Winfried Leiprecht, Aitrach; Rudolf Gottschling, Arnach; Silvia Emtmann, Isny, all of Germany

[73] Assignee: Diehl AKO Stiftung & Co., KG, Wangen, Germany

[21] Appl. No.: 09/269,112

[22] PCT Filed: Sep. 16, 1997

[86] PCT No.: PCT/EP97/05056

§ 371 Date: Jun. 4, 1999

§ 102(e) Date: Jun. 4, 1999

[87] PCT Pub. No.: WO98/12724

PCT Pub. Date: Mar. 26, 1998

[30] Foreign Application Priority Data

Sep. 20, 1996 [DE] Germany ..... 196 38 517

[51] Int. Cl.[7] ..... H05B 3/68

[52] U.S. Cl. ..... 219/448.16; 219/448.11

[58] Field of Search ..... 219/446.1, 448.11, 219/448.12, 448.16, 448.17, 448.18, 448.19, 460.1, 461.1, 462.1, 490, 494, 509, 510

[56] References Cited

U.S. PATENT DOCUMENTS 3,622,155 11/1971 Komazaki et al. ..... 219/448.16
4,388,520 6/1983 McWilliams ..... 219/448.19
4,810,857 3/1989 Goessler ..... 219/448.18

FOREIGN PATENT DOCUMENTS

3247028 A1 6/1984 Germany .
24 60 860 7/1986 Germany .
35 36 981 C2 4/1987 Germany .
89 14 470 8/1990 Germany .

OTHER PUBLICATIONS

HEA Bilderdienst 6.2, Aug. 1983; pp. 17 and 18.

*Primary Examiner*—Sang Paik
*Attorney, Agent, or Firm*—Scully, Scott, Murphy & Presser

[57] ABSTRACT

In a radiant heating body for a cooking location, in particular in the case of a glass ceramic plate (4), an insulating bottom (2) with an insulating annular rim portion (3) is provided in a pot member (1). A heating element (6) is arranged in an air space (5) above the insulating bottom (2). A safety temperature limiter is provided on the pot member (1). In order to achieve a low degree of switching hysteresis and to avoid an expansion bar regulator, the safety temperature limiter is in the form of a bimetal switch component (8) having a housing (9) which is fixed to the pot member (1) and in which a bimetal element (11) is disposed at the side: towards the air space (5). Provided at the annular rim portion (3) is an opening (20, 24) through which the bimetal element (11) is thermally coupled directly or indirectly to the air space (5).

15 Claims, 4 Drawing Sheets

RADIANT HEATING ELEMENT FOR A COOKING AREA

BACKGROUND OF THE INVENTION

1. Field of the Invention

The invention concerns a radiant heating body for a cooking location, in particular in relation to a glass ceramic plate, wherein an insulating bottom having an insulating annular rim portion is provided in a pot member and a heating element is arranged in an air space above the insulating bottom and a safety temperature limiter is provided on the pot member.

2. Discussion of the Prior Art

Radiant heating bodies of that kind are commercially known and are described for example in DE 35 36 981 C2. The safety temperature limiter serves to protect the glass ceramic plate from overheating. The safety temperature limiter comprises, in a tube, an expansion bar which extends in the air space above the heating element. An expansion bar regulator of that kind is a complicated and thus expensive component. Furthermore arranging the expansion bar in the air space involves a correspondingly large structural height in respect of the radiant heating body.

A glass ceramic cooking zone having an energy regulator and a bimetal regulator which is disposed laterally on the radiant heating body is described in HEA-Bilderdienst 6.2, August 1983, pages 17 and 18. The bimetal regulator is closed to start the cooking procedure. The bimetal regulator-opens at a cooking zone temperature of about 125° C. In this case also safety temperature limitation is effected by means of the expansion bar sensor of the energy regulator.

SUMMARY OF THE INVENTION

The object of the present invention is to propose a radiant heating body of the kind set forth in the opening part of this specification, in which an expansion bar is not required, while affording a low degree of switching hysteresis in respect of safety temperature limitation.

In accordance with the invention the foregoing object is attained in that as a safety temperature limiter there is provided a bimetal switch component having a housing or a base plate which is fixed to the pot member. A bimetal element is disposed in the housing or on the base plate at a side towards the air space. Formed in the annular rim portion is a through-opening through which the bimetal element is directly or indirectly thermally coupled to the air space.

The bimetal switch component is an inexpensive component and results, in a simple manner, in a sufficiently low level of switching hysteresis as it reacts quickly to the heat radiation from the heating element. Severe overshooting of the temperature beyond a limit value is also avoided as a result. A further advantage of the arrangement of the bimetal switch component is that there are various simple possible ways of setting or adjusting the response temperature of the bimetal member.

A structural advantage is that the bimetal switch component has practically no influence on the structural height of the radiant heating body because it does not extend in the air space between the insulating bottom and the glass ceramic plate.

Preferably the temperature at which the bimetal element responds is greater than 300° C. That substantially suppresses the influences of the ambient temperature of the radiant heating body.

In a preferred development of the invention the function of an adjustable energy regulator is integrated into the bimetal switch component. For that purpose, connected to the bimetal element or a switch contact which is actuable thereby is an adjusting member with which the response temperature of the bimetal element is adjustable.

BRIEF DESCRIPTION OF THE DRAWINGS

Further advantageous configurations of the invention are set forth in the appendant claims and the following description of embodiments by way of example. In the drawing:

DETAILED DESCRIPTION OF PREFERRED EMBODIMENTS

Figure 1:
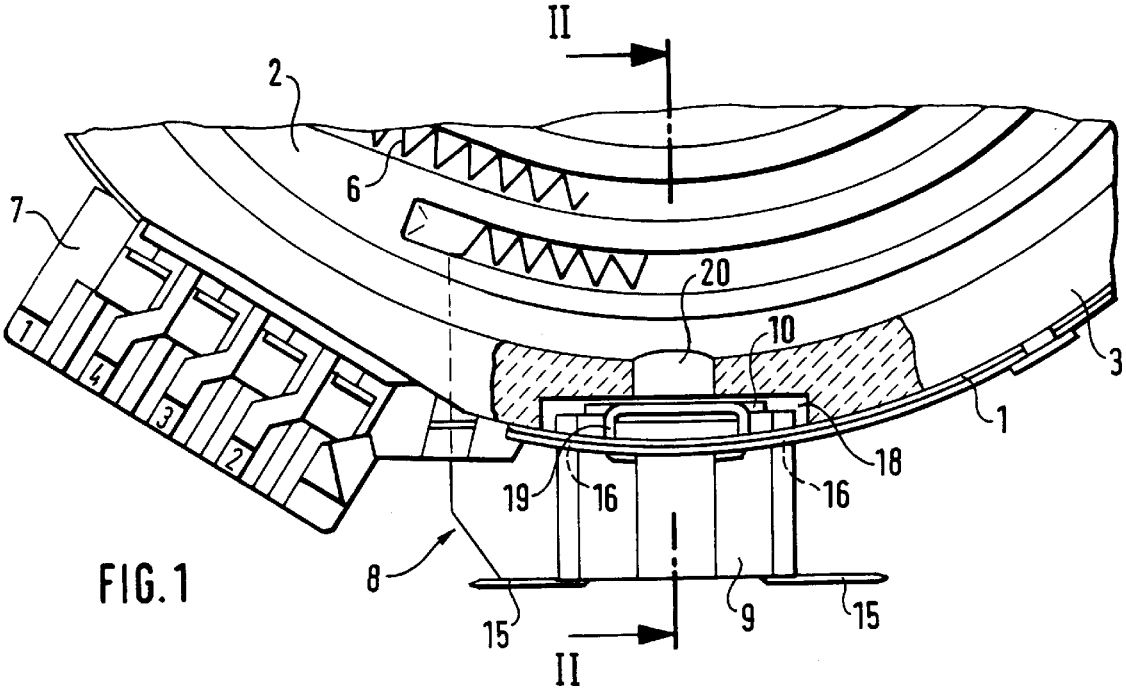
FIG. 1 is a plan view of part of a radiant heating body with a bimetal switch component in a first embodiment, with an annular member which is partially broken away in the drawing.

A radiant heating body has a pot member 1 in which is disposed an insulating bottom 2 comprising thermally and electrically insulating material. Provided in the pot member 1 is a thermally and electrically insulating annular rim portion which in the illustrated embodiments is formed by a separate annular member 3. In the embodiment shown in FIGS. 1 and 2 the insulating bottom 2 and the annular rim portion could also be formed in one piece. Between the insulating bottom 2 and a glass ceramic plate 4 which can be fitted on to the radiant heating body is an air space 5 in which a heating element 6 which radiates visibly in operation is arranged. In the illustrated embodiments the heating element shown is in the form of a heating coil laid in a spiral configuration. It is however also possible to provide other radiating heating elements, for example comprising flat wire or heating conductor foil or a halogen radiating arrangement. Disposed externally on the pot member 1 is a connecting plug 7 for the electrical connection of the heating element 6.

Figure 3:
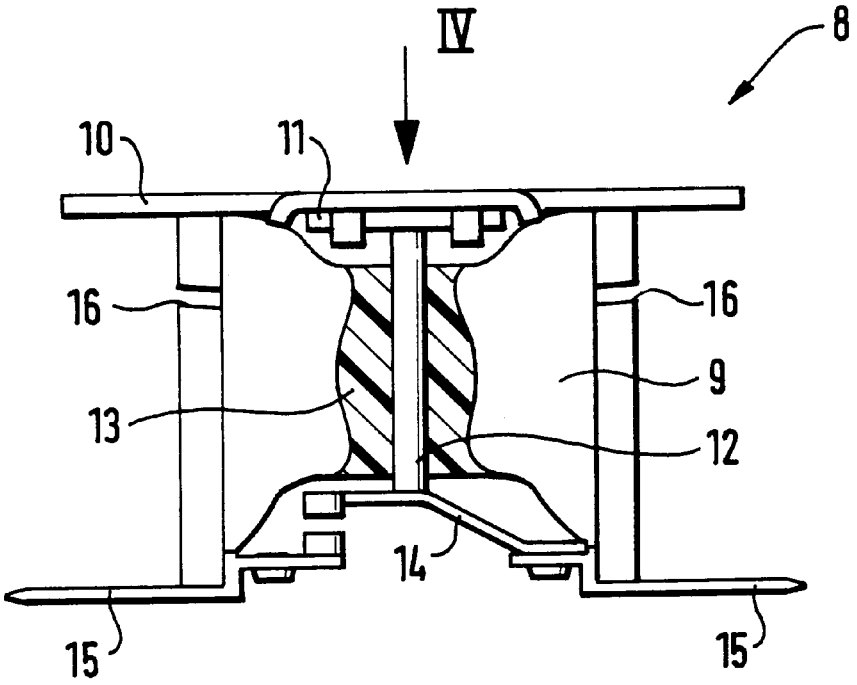
FIG. 3 is a partly sectional view of the bimetal switch component.

Provided as the safety temperature limiter is a bimetal switch component 8 whose ceramic housing 9 is closed by a metal base plate 10. In the interior of the housing 9 a bimetal element 11 bears in heat-conductive relationship against the base plate 10. The bimetal element 11 can be in the form of a snap disc. The bimetal element 11 is operatively connected to an electrical switch contact 14 by way of a ceramic pin 12 which is supported in a guide 13. Current connections 15 of the switch contact 14 are passed outwardly out of the housing 9 (see FIG. 3).

At both sides at a spacing from the base plate 10 the housing 9 has grooves 16 with which the housing 9 can be fitted into an opening 17 in the pot member 1, with the edges of the opening 17 engaging into the grooves 16. The switch component 8 is thereby fixed to the pot member 1 in a simple fashion, while thermal decoupling of the bimetal element 11 from the pot member 1 which usually comprises sheet metal and which is thus heat-conducting is achieved by way of the ceramic housing 9. The bimetal switch component 8 can also be fixed to the pot member 1 in another fashion, for example by means of a bracket.

In the assembled condition (see FIGS. 1 and 2, and FIGS. 5, 6 and 7), the base plate 10 lies in a recess 18 which is open towards the pot member 1, without touching the pot member 1, which promotes thermal decoupling of the base plate 10 from the pot member 1 and thus from its ambient temperature. In another construction the base plate 10 can bear against the pot member 1 and/or can be fixed thereto by being engaged into same. In that case, contact in point form or in line form is adopted, for example by means of knobs or ridges, to provide for the thermal decoupling effect, that is to say to provide for poor thermal coupling.

The current connections 15 are disposed outside the pot member 1. Clips 19 hold the base plate 10 to the housing 9. They do not represent substantial thermal bridges.

Figure 2:
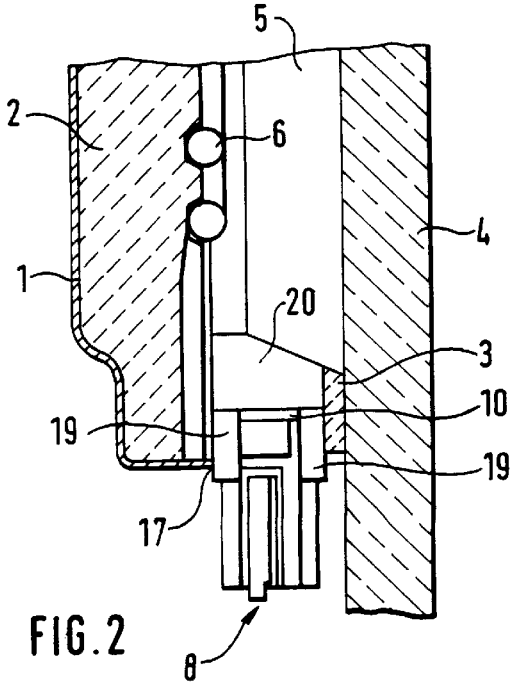
FIG. 2 is a view in section taken along line II—II in FIG. 1.
Figure 4:
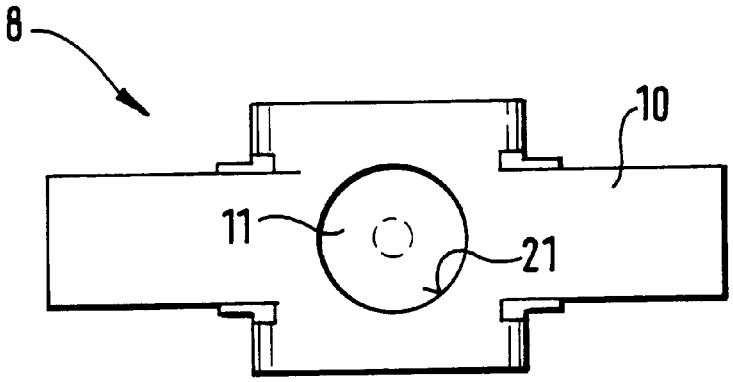
FIG. 4 is a view of the bimetal switch component viewing in the direction of the arrow IV in FIG. 3.

In the embodiment of FIGS. 1 and 2 direct thermal coupling is involved between the air space 5 and the bimetal element 11 which is connected to the base plate 10 in heat-conducting relationship. For that reason, in the region of the base plate 10 and therewith the bimetal element 11 the annular member 3 has a through passage 20. Heat radiation from the heating element 6 passes through the passage 20 and directly on to the base plate 10. If even more direct coupling is wanted, then the base plate 10 can have one or more openings in the region of the bimetal element 11. FIG. 4 shows such an opening at 21.

Figure 5:
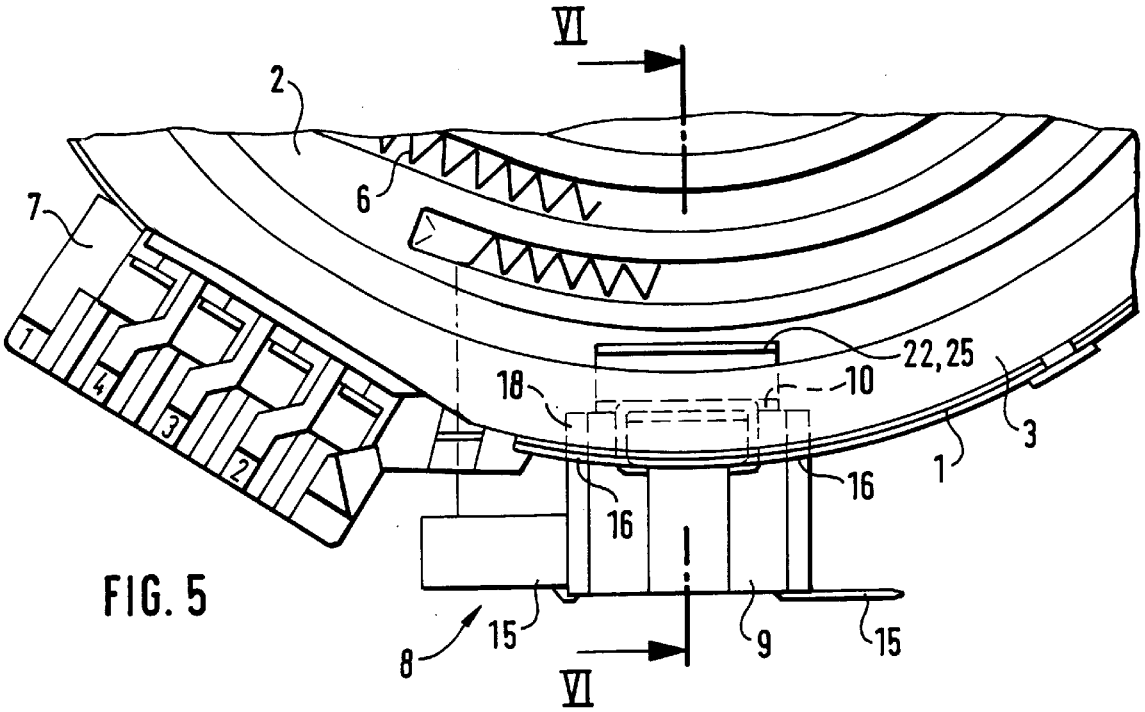
FIG. 5 is a plan view of part of a radiant heater with a bimetal switch component in a second embodiment.
Figure 6:
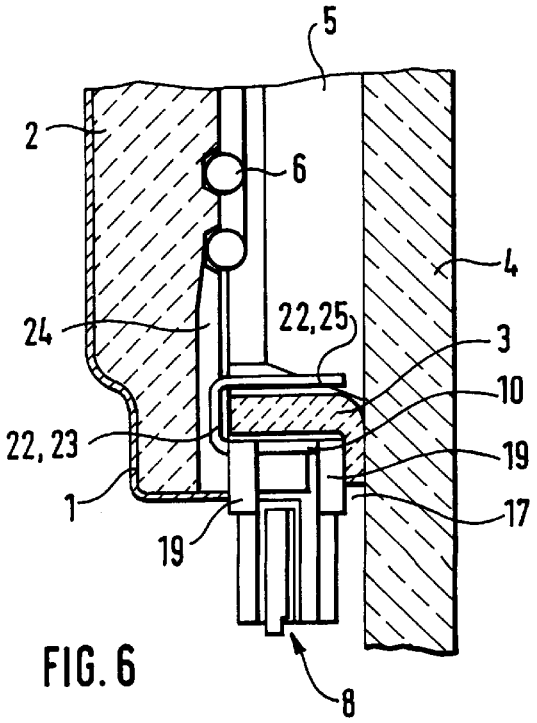
FIG. 6 is a view in section taken along line VI—VI in FIG. 5.

The embodiment shown in FIGS. 5 and 6 provides for indirect thermal coupling of the air space 5 to the bimetal element 11. For that purpose a heat-conducting portion 22 is provided on the base plate 10. The portion 22 has a limb 23 which extends through a through passage 24 which is provided between the annular member 3 and the insulating bottom 2. Adjoining the limb 23 is a limb 25 which is disposed in the air space 5 beside the heating element 6. The limb 25 is disposed approximately where the passage 20 is to be found in the embodiment shown in FIGS. 1 and 2. The heat-conducting portion 22 can be formed in one piece with the base plate 10 or it can be in the form of a separate member which is secured thereto.

Reception of the thermal radiation which emanates from the heating element 6 can be improved if the limb 25 in the embodiment shown in FIGS. 5 and 6 or the base plate 10 in the embodiment shown in FIGS. 1 and 2 is coloured, preferably blackened, matted and/or roughened, at the surface which is towards the heating element 6. In the embodiment shown in FIGS. 1 and 2 the bimetal element 11 itself is additionally also coloured, preferably blackened,and/or matted, opposite the opening 21. In order to provide for rapid reaction of the bimetal element 11 to the radiant heat from the heating element 6, it is also advantageous if the surface, that is exposed to the radiation, of the limb 25 or the base plate 10 is of large area, if the heat-conducting portion 22 or the base plate 10 is of small mass and comprises a material which is a good conductor of heat.

The bimetal temperature at which the bimetal element 11 switches is preferably in the range of between 300° C. and 500° C. It is advantageous to choose such a high temperature because then the ambient temperature of the pot member 1 scarcely has any influence on the switching characteristics. The above-described direct or indirect coupling arrangements make it possible to provide for adaptive adjustment such that the bimetal member reliably opens the switch contact 14 at a temperature which is critical for the glass ceramic plate 4 and which is at a given limit value, depending on the construction involved, between 530° C. and 630° C., at the top side of the glass ceramic plate, without involving excessive overshooting of the limit temperature. Switching hysteresis of the switch contact 14 can also be kept to a desired low value, for example 30 K, by virtue of the described coupling arrangements.

Besides being influenced by the above-described measures, opening of the switch contact 14 at the limit temperature of the glass ceramic plate 4 can also be influenced by the following steps:

a) the bimetal element 11 is suitably pre-shaped;

b) the spacing of the base plate 10 or the bimetal element 11 from the heating element 6 is suitably selected;

c) the size of the passage 20 is suitably adopted; and d) the position of the base plate 10 or the bimetal element 11 is related to the hottest region of the heating element 6.

Figure 8:
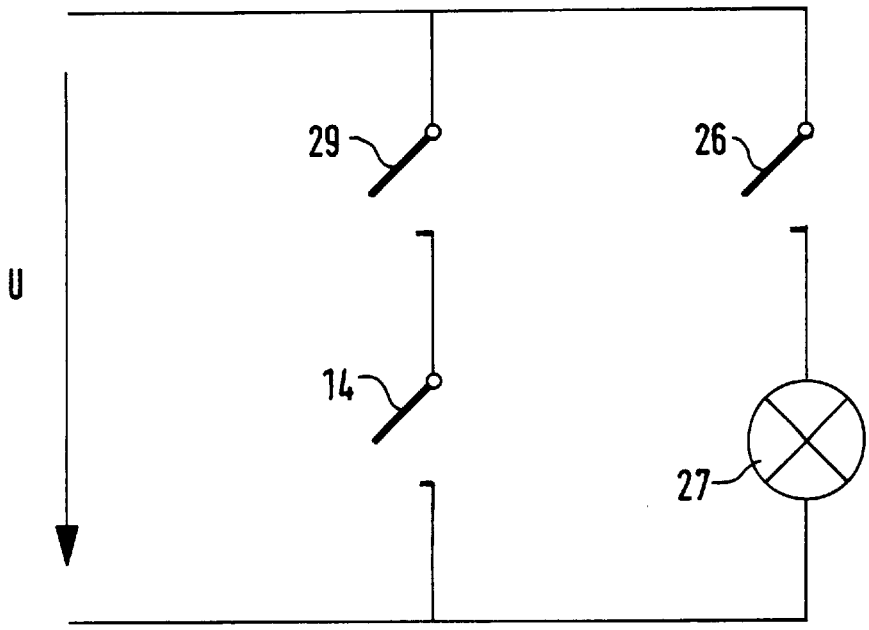

The bimetal switch component 8 may also have a second switch contact 26 which is controllable by the bimetal element 11 or a further bimetal element 11, possibly a further bimetal switch component 8. A per se known optical residual heat display, for example a glow lamp 27, may be operated with that second switch contact 26 (see FIG. 8 ). It is also possible for two bimetal switch components to be arranged on the pot member 1 in the described manner, in which case one serves for safety temperature limitation and the other is adjusted to a lower temperature, for example less than 100° C., for the residual heat display.

Figure 7:
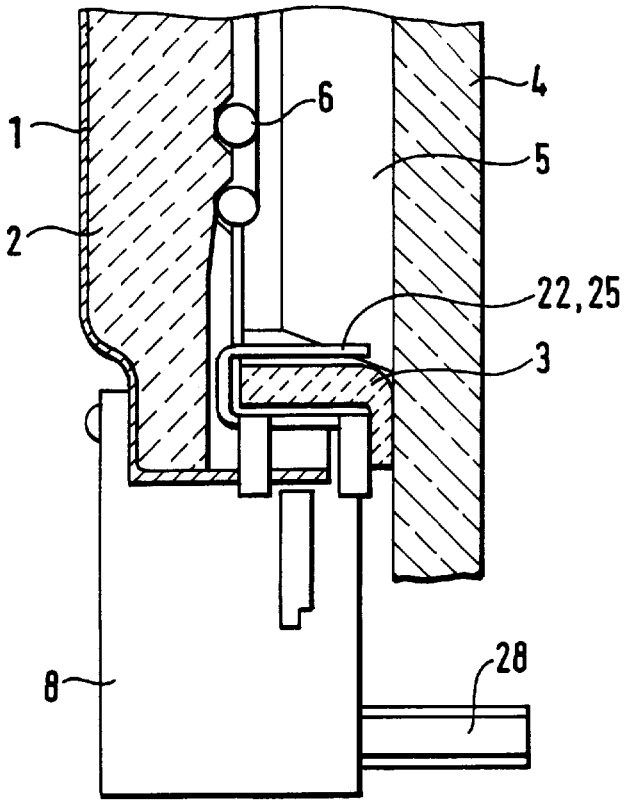
FIG. 7 shows an embodiment with integrated power regulation, and FIG. 8 diagrammatically shows a circuit diagram.

In the embodiment shown in FIG. 7 the bimetal switch component 8 has a rotatable adjusting member 28 connected to a rotary handle which can be operated by the user. The temperature at which the switch contact 14 or a third switch contact 29 (see FIG. 8) opens below the limit temperature of the glass ceramic plate 4 can be adjusted by means of the adjusting member 28 which acts on the bimetal element 11 or the switch contact 14. Thus, besides the function of providing for safety temperature limitation, the bimetal switch component 8 also implements the function of energy regulation for the cooking hob with a low level of switching hysteresis and a small degree of overshoot.

What is claimed is:

1. A radiant heating body for a cooking location, in particular in relation to a ceramic glass plate, wherein an insulating bottom having an insulating annular rim portion is provided in a pot member and heating element is arranged in an air space above the insulating bottom and a and a safety temperature limiter is provided on the pot member, wherein the safety temperature limiter comprises a bimetal switch component (8) having a ceramic housing (9), a metal base plate (10) closing said housing, said housing being fitted through grooves (16) into an opening (17) formed in the pot member (1), a bimetal element (11) disposed in the housing (9) in electrical contact with the base plate (10), at a aide facing towards the air space (5), and the annular rim portion (3) being provided with a through opening (10, 24) through which the bimetal element (11) is thermally coupled selectively directly or indirectly to the air space (5), wherein the current connections (15) of the switch contact (14) of the bimetal switch component (8) lie outside the pot member (1).

2. A radiant heating body according to claim 1 characterised in that the bimetal element (11) bears in the housing (9) in the heat-conductive relationship against said metal base plate (10) which is disposed within the pot member (1) between the pot member (1) and the annular rim portion (3).

3. A radiant heating body according to claim 1, characterised in that the base plate (10) bears against the pot member (1) in point contact.

4. A radiant heating body according to claim 1, characterised in that in the region of the bimetal element (10) the base plate (10) has at least one opening (21) in alignment with said bimetal element (11).

5. A radiant heating body according to claim 1 characterised in that the base plate (10) and the bimetal element (11) are disposed opposite the opening (20) in the annular rim portion (3) and are exposed through said opening (20) to the radiant heat emanating from the heating element (6).

6. A radiant heating body according to claim 1 characterised in that a heat-conducting portion (22) is formed or fixed on the base plate (10) and extends through the passage opening (24) into the air space (5).

7. A radiant heating body according to claim 6 characterised in that the heat-conducting portion (22) is disposed in the air space (5) with respect to the plane of the cooking hob beside the heating element (6).

8. A radiant heating body according to claim 1, characterised in that at the surface towards the air space (5) and the heating element (6) the base plate (10), the bimetal element (11) and the heat-conducting portion (22) are selectively colored, matted and roughened, to improve reception of the radiant heat emanating from the heating element (6).

9. A radiant heating body according to claim 1 characterised in that the bimetal element (11) switches at a temperature above 250° C.

10. A radiant heating body according to claim 1 characterised in that the bimetal switch component (8) is fixed by means of the base plate (10) to the pot member (1), wherein the base plate (10) bears against the pot member (1) only in point form or line form.

11. A radiant heating body according to claim 1 characterised in that an adjusting member (28) for energy regulation is connected to the bimetal element (11) or a switch contact (14, 29) actuable thereby.

12. A radiant heating body according to claim 1 characterised in that the bimetal switch component (8) has a second switch contact for a residual heat display.

13. A radiant heating body according to claim 1 characterised in that arranged on the pot member (1) is a further bimetal switch component having a switch contact for the residual heat display.

14. A radiant heating body according to claim 12 or claim 13 characterised in that the bimetal element for the residual heat display switches at a temperature of less than 100° C.

15. A radiant heating body according to claim 1, characterised in that the base plate (10) bears against the pot member (1) in a linear contact.

* * * * *